US010411332B2

(12) United States Patent
Shin

(10) Patent No.: US 10,411,332 B2
(45) Date of Patent: Sep. 10, 2019

(54) VEHICLE STARTING APPARATUS

(71) Applicants: HYUNDAI MOTOR COMPANY, Seoul (KR); KIA MOTORS CORPORATION, Seoul (KR)

(72) Inventor: Sang Hoon Shin, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/978,410

(22) Filed: May 14, 2018

(65) Prior Publication Data

US 2019/0190134 A1 Jun. 20, 2019

(30) Foreign Application Priority Data

Dec. 19, 2017 (KR) ..... 10-2017-0174680

(51) Int. Cl.

| | |
|---|---|
| ***H01Q 1/32*** | (2006.01) |
| ***H01Q 7/00*** | (2006.01) |
| ***H01H 13/50*** | (2006.01) |
| ***F02N 11/08*** | (2006.01) |

(52) U.S. Cl.
CPC ..... *H01Q 1/3233* (2013.01); *H01Q 7/00* (2013.01)

(58) Field of Classification Search
CPC .. F02N 11/08; F02N 11/0807; F02N 11/0814; F02N 11/0874; H01H 1/58; H01H 13/50; H01H 13/52; H01H 9/0271; H01Q 1/32; H01Q 1/3233; H01Q 1/3241; H01Q 1/3291; H01Q 7/00
See application file for complete search history.

(56) References Cited

U.S. PATENT DOCUMENTS

| | | | | |
|---|---|---|---|---|
| 9,437,920 | B2 * | 9/2016 | Sano | H01Q 7/08 |
| 9,543,089 | B2 * | 1/2017 | Kirita | H01H 13/52 |
| 9,562,507 | B2 * | 2/2017 | Sago | F02N 11/0807 |
| 10,026,545 | B2 * | 7/2018 | Miura | H01F 27/325 |
| 10,186,774 | B2 * | 1/2019 | Tanaka | H01Q 1/2208 |
| 2015/0179369 | A1 | 6/2015 | Choi et al. | |
| 2015/0337788 | A1 | 11/2015 | Sago et al. | |

FOREIGN PATENT DOCUMENTS

| | | | |
|---|---|---|---|
| KR | 10-2009-0126981 | A | 12/2009 |
| KR | 10-2012-0050040 | A | 5/2012 |
| KR | 10-1327020 | B1 | 11/2013 |
| KR | 10-1651555 | B1 | 8/2016 |

* cited by examiner

*Primary Examiner* — Tho G Phan
(74) *Attorney, Agent, or Firm* — Brinks Gilson & Lione

(57) ABSTRACT

Disclosed is a vehicle starting apparatus including: a cylindrical antenna assembly housing opened at an upper portion and a lower portion; a cylindrical switch housing disposed inside the antenna assembly housing; a moving body slidably installed in the switch housing; a button cap fixed to cover an upper portion of the moving body; a circuit board disposed below the moving body; a connector connected to the circuit board for electrical connection with another device; and an antenna coil provided in the antenna assembly housing to exchange a wireless signal with a starter key. In particular, the antenna coil is electrically connected to the another device through the connector via the circuit board.

10 Claims, 4 Drawing Sheets

VEHICLE STARTING APPARATUS

CROSS-REFERENCE TO RELATED APPLICATION

This application claims priority to and the benefit of Korean Patent Application No. 10-2017-0174680, filed on Dec. 19, 2017, which is incorporated herein by reference in its entirety.

FIELD

The present disclosure relates to a starting apparatus used for operating an engine of a vehicle.

BACKGROUND

The statements in this section merely provide background information related to the present disclosure and may not constitute prior art.

A typical vehicle is started by a key when a driver inserts the key into a key box and rotates it to start an engine and release the locking of a steering shaft. In recent years, an automatic starting method using a PIC unit (Personal Identification Card Unit), namely a smart key, has been applied to some high-end automobiles, thereby greatly improving convenience.

In a method of starting an engine using the PIC unit, if a driver holds a FOB key or the FOB key is stored in a vehicle, when the driver places the shift lever at the parking position (P), presses the brake pedal, and then presses a start button of the vehicle, the engine is started through wireless communication between the FOB key and the PIC unit. To turn off the engine, the driver presses the brake pedal, switches the shift lever to the parking position, and then presses the start button.

Since the above-described starting method is based on wireless communication, it is not possible to start an engine when the battery of the FOB key is discharged, or when the PIC unit or the like in the vehicle cannot communicate wirelessly. In this situation, an emergency starting method should be used.

An antenna coil required for an emergency starting is usually built into a start button. In this form, we have discovered that the start button is mounted in front of an inner panel of a vehicle, and thus a mounting hole should be larger than the diameter of a body housing of the start button, and thus there is a drawback that a bezel thickness is excessively large compared to the diameter of the start button and its appearance is undermined. We have further discovered that this form of the start button requires a significant package space, and thus acts as a constraint in designing related components. Furthermore, if a button cap is made of a metallic material (plated or aluminum) for the sake of high quality, it is difficult to secure the antenna communication performance by the shielding effect due to the material characteristics.

SUMMARY

The present disclosure provides a vehicle starting apparatus which can reduce manufacturing processes and manufacturing costs, and facilitates the securing of space by separately manufacturing an antenna coil for executing an authentication procedure for a driver from a start button.

Additional aspects of the present disclosure will be set forth in part in the description which follows and, in part, will be obvious from the description, or may be learned by practice of the disclosure.

In one form of the present disclosure, a vehicle starting apparatus includes a cylindrical antenna assembly housing that is open at an upper portion and a lower portion thereof, a cylindrical switch housing disposed inside the antenna assembly housing, a moving body slidably installed in the switch housing, a button cap fixed to cover an upper portion of the moving body, a circuit board disposed below the moving body, a connector connected to the circuit board for electrical connection with another device, and an antenna coil provided in the antenna assembly housing to exchange a wireless signal with a starter key of a vehicle. In particular, the antenna coil is electrically connected to the another device through the connector via the circuit board.

The vehicle starting apparatus may further include a first contact provided in the antenna assembly housing and electrically connected to the antenna coil, and a second contact provided in the switch housing and electrically connected to the first contact. The first contact and the second contact may be electrically connected to each other when the switch housing is coupled to the antenna assembly housing.

The first contact may be located in a front of the antenna assembly housing near a dashboard.

The antenna assembly housing may include a cylindrical bracket member provided with a fastening portion and the antenna assembly housing is open at an upper portion and a lower portion thereof. The vehicle starting apparatus further includes an antenna coil assembly coupled to an inside of the bracket member, and the antenna coil is coupled to an outer circumferential surface of the antenna coil assembly.

The antenna coil may be installed in a groove provided on an outer circumferential surface of a front upper portion of the antenna coil assembly.

The fastening portion may be fixedly fastened to a dashboard near a steering wheel of a vehicle.

The antenna assembly housing may have a structure in which a coupling protrusion of the antenna coil assembly is inserted into and coupled to a coupling groove provided in the bracket member.

The antenna coil may be provided adjacent to the button cap, and the first contact and the second contact may be respectively provided adjacent to the circuit board when the switch housing is coupled to the antenna assembly housing.

The circuit board may be provided with an elastic protrusion contacting a lower end surface of the moving body to provide a restoring force to the moving body.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

The drawings described herein are for illustration purposes only and are not intended to limit the scope of the present disclosure in any way.

DETAILED DESCRIPTION

Hereinafter, exemplary forms of the present disclosure will be described in detail with reference to the accompanying drawings. The following forms are provided to fully convey the spirit of the present disclosure to a person having ordinary skill in the art to which the present disclosure belongs. The present disclosure is not limited to the forms shown herein but may be embodied in other forms. The drawings are not intended to limit the scope of the present disclosure in any way, and the size of components may be exaggerated for clarity of illustration.

Figure 1:
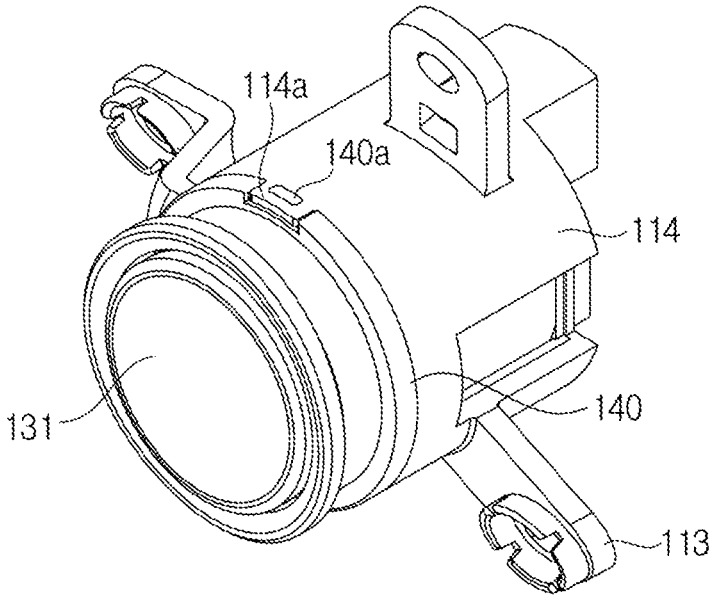
FIG. 1 is a front perspective view of a vehicle starting apparatus.
Figure 2:
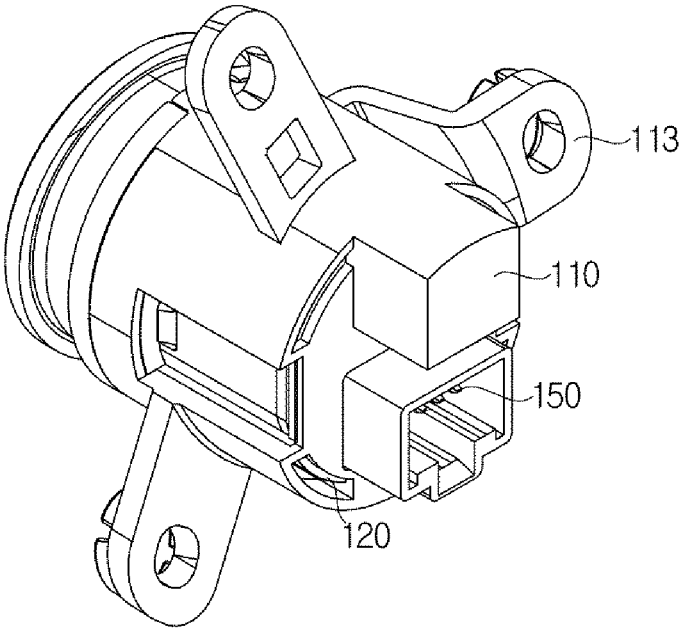
FIG. 2 is a rear perspective view of a vehicle starting apparatus.
Figure 3:
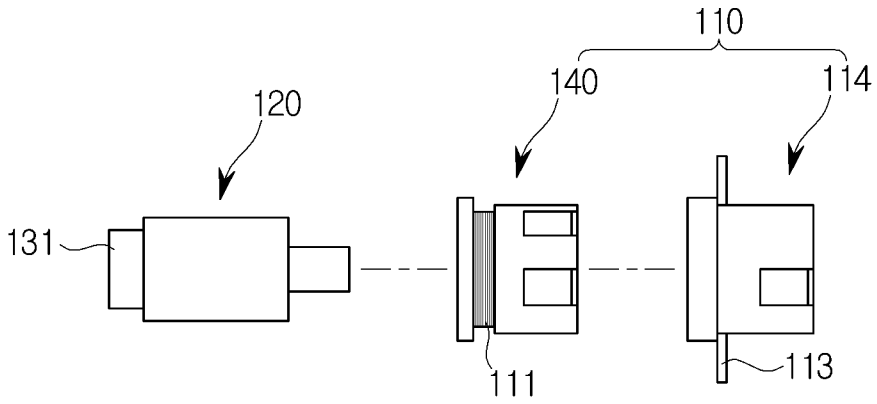
FIG. 3 is a schematic exploded view of a vehicle starting apparatus.
Figure 4:
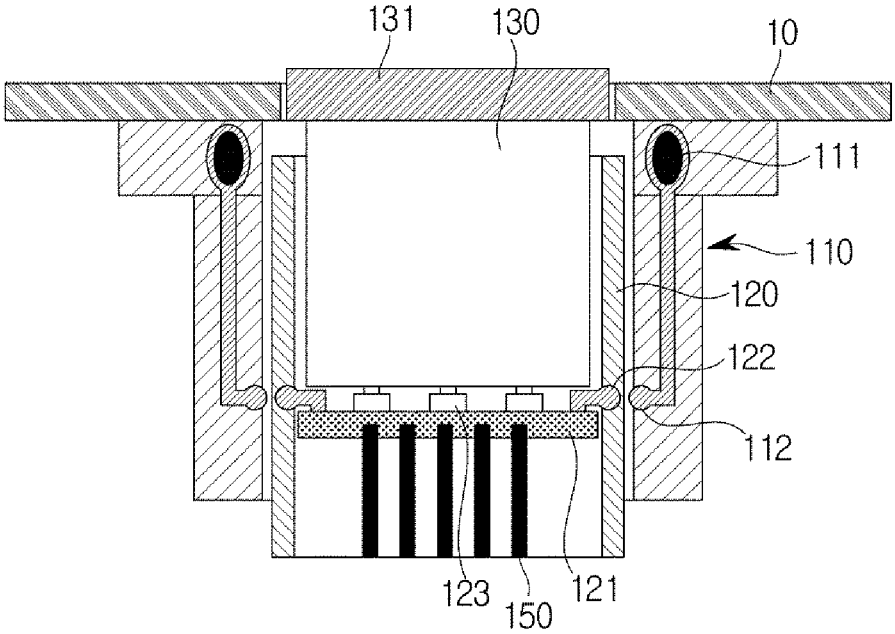
FIG. 4 is a schematic cross-sectional view of a vehicle starting apparatus.

FIG. 1 is a front perspective view of a vehicle starting apparatus 100 in one form of the present disclosure, FIG. 2 is a rear perspective view of the vehicle starting apparatus 100, FIG. 3 is a schematic exploded view of the vehicle starting apparatus 100, and FIG. 4 is a schematic cross-sectional view of the vehicle starting apparatus 100. Each element shown in the cross-sectional view of FIG. 4 may be represented somewhat differently from that of FIGS. 1 and 2, but the same reference numerals may indicate the same elements. In particular, in FIG. 4, an antenna coil assembly 140 and a bracket member 114 are simplified as one antenna assembly housing 110.

Referring to the drawings, a vehicle starting apparatus 100 may include a cylindrical antenna assembly housing 110 opened at an upper portion and a lower portion thereof, a cylindrical switch housing 120 disposed inside the antenna assembly housing 110, a moving body 130 slidably installed in the switch housing 120, a button cap 131 fixed to cover an upper portion of the moving body 130, a circuit board 121 disposed below the moving body 130, a connector 150 connected to the circuit board 121 for electrical connection with another device, and an antenna coil 111 provided in the antenna assembly housing 110. In particular, the antenna coil 111 may be electrically connected to the another device through the connector 150 via the circuit board 121.

The antenna assembly housing 110 has a structure in which an antenna coil assembly 140 is combined with a cylindrical bracket member 114 which is provided with a fastening portion 113 and opened at an upper portion and a lower portion thereof, and the switch housing 120 and the circuit board 121 are accommodated in the antenna assembly housing 110. The antenna assembly housing 110 may be relatively fixed to a dashboard 10 near a steering wheel of a vehicle via the fastening portion 113, but the mounting position is not limited thereto. Further, the antenna assembly housing 110 may be provided in such a manner that the antenna coil assembly 140 is directly fastened to the dashboard 10 or the like in a form in which the bracket member 114 provided with the fastening portion 113 is removed, but is not limited thereto.

The switch housing 120 in which a space is formed, the moving body 130, and the button cap 131 may be disposed in the antenna coil assembly 140 that is a cylindrical member which is opened at upper and lower portions thereof and has a groove on an outer circumferential surface of a front upper portion thereof to accommodate the antenna coil 111 therein. The antenna coil assembly 140 has a coupling protrusion **140*a* formed on an outer circumferential surface spaced apart from the upper end thereof by a predetermined distance so that the coupling protrusion 140*a* is coupled to a coupling groove 114*a* of the bracket member 114**.

The switch housing 120, which is a cylindrical member opened at upper and lower portions thereof, has a space formed therein so that the moving body 130 and the button cap 131 are accommodated. The moving body 130 is integrally coupled to the button cap 131 and disposed inside the switch housing 120 so as to be slidable with respect to the switch housing 120. A lower end surface of the moving body 130 is brought into contact with at least two or more elastic protrusions 123 provided on an upper portion of the circuit board 121 so that the moving body 130 pushes the elastic protrusions 123 when a switch is operated, and then is restored by a restoring force when an external force is removed.

The elastic protrusions 123 are made of a material having an elastic restoring force such as a rubber material and function to turn on or off switches provided on the circuit board 121. The elastic protrusions 123 provide an elastic restoring force for moving the moving body 130 to its original position when an external force is removed after the button cap 131 integrally coupled to the moving body 130 is pressed by the external force. On the other hand, characters may be engraved on an upper surface of the button cap 131 so that the light, which is generated from light emitting diodes provided on the circuit board 121 at the time of switch on/off, can be transmitted through the engraved portion to improve the visibility.

The circuit board 121 serves to recognize a signal of a driver's starter key, to emit a plurality of light emitting diodes, and to generate signals related to the operation of an engine start motor and a fuel pump. The circuit board 121 is provided with the connector 150 electrically connected to another device and the plurality of light emitting diodes electrically connected to the connector 150.

The antenna coil 111 may be provided for short-range communication of a Fob key for user authentication when the battery output is low in the Fob key in a smart key system. The antenna coil 111 is electrically connected to the circuit board 121 through a first contact 112 and a second contact 122. At this time, in order to achieve efficient and fast operation, the antenna coil 111 is provided near the button cap 131, and the first contact 112 connected to the antenna coil 111 and the second contact 122 connected to the circuit board 121 are provided near the circuit board 121, respectively.

Hereinafter; the operation of the vehicle starting apparatus 100 having the above-described configuration will be described.

First, the button cap 131 is fitted on an upper side of the moving body 130. Next, the moving body 130, which is integrally coupled to the button cap 131, is inserted and assembled into the switch housing 120, and the switch housing 120 is inserted and assembled into the inside of the antenna assembly housing 110.

When a driver exerts an external force on the button cap 131 the button cap 131 is moved downward along the inner circumferential surface of the switch housing 120 integrally with the moving body 130, and the lower end surface of the moving body 130 presses the elastic protrusions 123 to elastically deform the elastic protrusions 123. At this time, the elastic protrusions 123 serve to actuate switches provided on the circuit board 121. When the driver removes the external force applied to the button cap 131, the moving body 130 is moved to its original position due to the elastic restoring force of the elastic protrusions 123.

As described above, since the vehicle starting apparatus 100 is configured such that when the antenna coil 111 is housed in the antenna assembly housing 110 and the switch housing 120 is assembled to the antenna assembly housing 110, the first contact 112 and the second contact 122 are connected to each other to form a circuit, it is possible to downsize the vehicle starting apparatus by using the same production process as conventional process in the art and by eliminating the design constraints while integrally implementing the local communication using the antenna coil 111 and the button operation using the button cap 131, thereby improving flexibility in designing the apparatus and its package.

Further, since the width of the bezel of the vehicle starting apparatus 100 is reduced regardless of the method (e.g., front or rear mountings) of mounting the vehicle starting apparatus 100 on the dashboard 10, it is possible to improve the competitiveness of the interior design of a vehicle, and it is possible to secure commercial value of the appearance due to no restriction on the material selection of the button cap 131.

As is apparent from the above, the vehicle starting apparatus includes an antenna coil separated from the switch housing and installed in the antenna assembly housing such that design constraints found in the art can be avoided and thus improves freedom in plan/design/package.

Hereinabove, although the present disclosure has been described with reference to exemplary forms and the accompanying drawings, the present disclosure is not limited thereto, but may be variously modified and altered by those skilled in the art to which the present disclosure pertains without departing from the spirit and scope of the present disclosure.

What is claimed is:

1. A vehicle starting apparatus comprising:

an antenna assembly housing;

a switch housing disposed inside the antenna assembly housing;

a moving body slidably installed in the switch housing;

a button cap fixed to cover an upper portion of the moving body;

a circuit board disposed below the moving body;

a connector connected to the circuit board for electrical connection with a device; and an antenna coil provided in the antenna assembly housing and configured to exchange a wireless signal with a starter key of a vehicle, wherein the antenna coil is electrically connected to the device through the connector via the circuit board.

2. The vehicle starting apparatus according to claim 1, wherein the antenna assembly housing is in a cylindrical shape that is open at an upper portion and a lower portion thereof.

3. The vehicle starting apparatus according to claim 1, further comprising:

a first contact provided in the antenna assembly housing and electrically connected to the antenna coil; and a second contact provided in the switch housing and electrically connected to the first contact, wherein the first contact and the second contact are electrically connected to each other when the switch housing is coupled to the antenna assembly housing.

4. The vehicle starting apparatus according to claim 3, wherein:

the antenna assembly housing comprises a bracket member provided with a fastening portion and the antenna assembly housing is open at an upper portion and a lower portion thereof, the vehicle starting apparatus further comprises an antenna coil assembly coupled to an inside of the bracket member, and the antenna coil is coupled to an outer circumferential surface of the antenna coil assembly.

5. The vehicle starting apparatus according to claim 4, wherein the antenna coil is installed in a groove provided on an outer circumferential surface of a front upper portion of the antenna coil assembly.

6. The vehicle starting apparatus according to claim 4, wherein the fastening portion is fixedly fastened to a dashboard near a steering wheel of the vehicle.

7. The vehicle starting apparatus according to claim 4, wherein the antenna assembly housing has a structure in which a coupling protrusion of the antenna coil assembly is inserted into and coupled to a coupling groove provided in the bracket member.

8. The vehicle starting apparatus according to claim 3, wherein the antenna coil is provided adjacent to the button cap, and the first contact and the second contact are respectively provided adjacent to the circuit board when the switch housing is coupled to the antenna assembly housing.

9. The vehicle starting apparatus according to claim 8, wherein the first contact is located in a front of the antenna assembly housing near a dashboard.

10. The vehicle starting apparatus according to claim 1, wherein the circuit board is provided with an elastic protrusion contacting a lower end surface of the moving body and configured to provide a restoring force to the moving body.

* * * * *